US005411202A

United States Patent [19]

Fenini

[11] Patent Number: 5,411,202

[45] Date of Patent: May 2, 1995

[54] PACKAGE HAVING A SEALING WRAPPER WITH A TEAR STRIP EASY-OPENING DEVICE

[75] Inventor: Federico Fenini, Parma, Italy

[73] Assignee: Barilla G. eR. F.lli - Societa per Azioni, Parma, Italy

[21] Appl. No.: 127,062

[22] Filed: Sep. 27, 1993

[30] Foreign Application Priority Data

Sep. 30, 1992 [IT] Italy ..... MI92A02270

[51] Int. Cl.[6] ..... B65D 27/38

[52] U.S. Cl. ..... 229/87.05; 383/205

[58] Field of Search ..... 229/87.05, 926; 383/201, 205, 206, 207, 208, 209

[56] References Cited

U.S. PATENT DOCUMENTS 4,638,911 1/1987 Prohaska ..... 383/205
4,666,079 5/1987 Bolli et al. ..... 229/87.05
4,725,329 2/1988 Tani ..... 229/926 X
4,834,245 5/1989 Ohga et al. ..... 383/201
5,184,771 2/1993 Jud et al. ..... 229/87.05
5,215,249 6/1993 Gorrieri ..... 229/87.05

FOREIGN PATENT DOCUMENTS 558283 7/1975 Switzerland .
0752160 7/1956 United Kingdom ..... 383/206
9306023 4/1993 WIPO ..... 229/87.05

*Primary Examiner*—Allan N. Shoap
*Assistant Examiner*—Jes F. Pascua
*Attorney, Agent, or Firm*—Sughrue, Mion, Zinn, Macpeak & Seas

[57] ABSTRACT

A package having a sealed wrapper with a longitudinal package closure fin and a tear strip disposed in a loop transversely of the closure fin, in which the closure fin is provided, at an intersection with the tear strip with two incisions which at low easy and complete division of the wrapper into half wrappers by the tear strip.

5 Claims, 3 Drawing Sheets

PACKAGE HAVING A SEALING WRAPPER WITH A TEAR STRIP EASY-OPENING DEVICE

BACKGROUND OF THE INVENTION

The present invention relates to a finned package, namely one with a sealed wrapper having a longitudinal fin or closure flap, provided with a tear-strip easy-opening device.

It is known that in many sectors of the food industry, especially that of sweets and pasta, wide use is made, for distribution of the products, of packages in which the food product, in relatively rigid boxes or trays of plastics or card material, is further enclosed, together with the rigid container, in a sealed wrapper, generally made with sheets of various materials (paper, aluminium, plastics) connected together.

The Function of the wrapper is to protect the food product from ultra-violet and visible radiation, pollution by external agents, water, bacteria, fungi and insects.

One type of wrapper particularly used is that known as a "flow-pack" in which a flat rectangular sheet is first folded back on itself in such a way as to bring together two opposite edges, which are welded together so as to form a kind of tube in which the product to be protected is housed, and which is then subsequently sealed at its two free ends.

The various welding operations on the edges are in general effected by simultaneous heat and pressure.

This type of wrapper is characterised by a longitudinal fin constituted by the juxtaposition of the two edges of the material of the wrapper which are welded together, and by two tranverse flaps sealing the package.

The opening of this type of package without cutting instruments (scissors, knives) is particularly difficult due to the toughness of the material used for the wrapper and involves the risk of damage to the products contained therein.

It is desirable to provide this type of package with easy-opening devices using tear strips of the type such as those used for other types of packages and for other types of products, such as cigarettes, chewing gum etc, in which a thin plastics film of wrapper is cut by a thread or strip disposed inside the wrapper entirely around an inner container or the product itself so as to form a loop with its ends superimposed but not welded; tearing one end opens the loop thereby separating the whole of the outer wrapper into two separate parts.

Unfortunately it has not until now been possible to obtain the combination of the two characteristics, namely flow-pack with longitudinal fin and tear strip in a single package and achieve the overall desired result.

In fact, attempts to combine the two characteristics give rise to packages in which the tear strip possibly succeeds in tearing and cutting the wrapper where it is not superimposed at its edges, but not at the flaps, and particularly at the longitudinal fin, where the wrapper becomes, because of the sealing, particularly tough, relatively rigid and sharply folded outwardly with respect to the shape of the other surfaces of the wrapper which take up the shape of the inner container or product and are therefore flat or at most convex.

At the flap the tear strip, rather than tearing through the flap, becomes separated from the flap without achieving the desired effect of separating the wrapper into two separate parts to allow easy removal of the contents.

SUMMARY OF THE INVENTION

To obviate this disadvantage the subject of the present invention is a package having a sealed wrapper and a tear strip easy-opening device, in which the said problem is entirely eliminated and complete separation of the wrapper into two distinct parts by means of the tear strip is therefore possible.

According to the invention this result is achieved by providing a package having a sealed wrapper in which there is provided a tear-strip extending transversely of the longitudinal sealing fin and at the fold formed by the fin where the fin is intersected by the tear strip, providing incisions which locally weaken the wrapper thereby reducing its rigidity and facilitating the propagation transversely of the fin of the tear caused upon opening caused by the thread.

According to a further aspect of the invention the incisions are associated with a particular shape of the fin weld which provide a "starter" for the opening tear and a "reserve zone" for the incisions.

BRIEF DESCRIPTION OF THE DRAWINGS

The characteristics and advantages of the invention will become clearer from the following description of a preferred embodiment of the invention and its variants, made with reference to the attached drawings, in which.

DETAILED DESCRIPTION OF THE INVENTION

Figure 1:
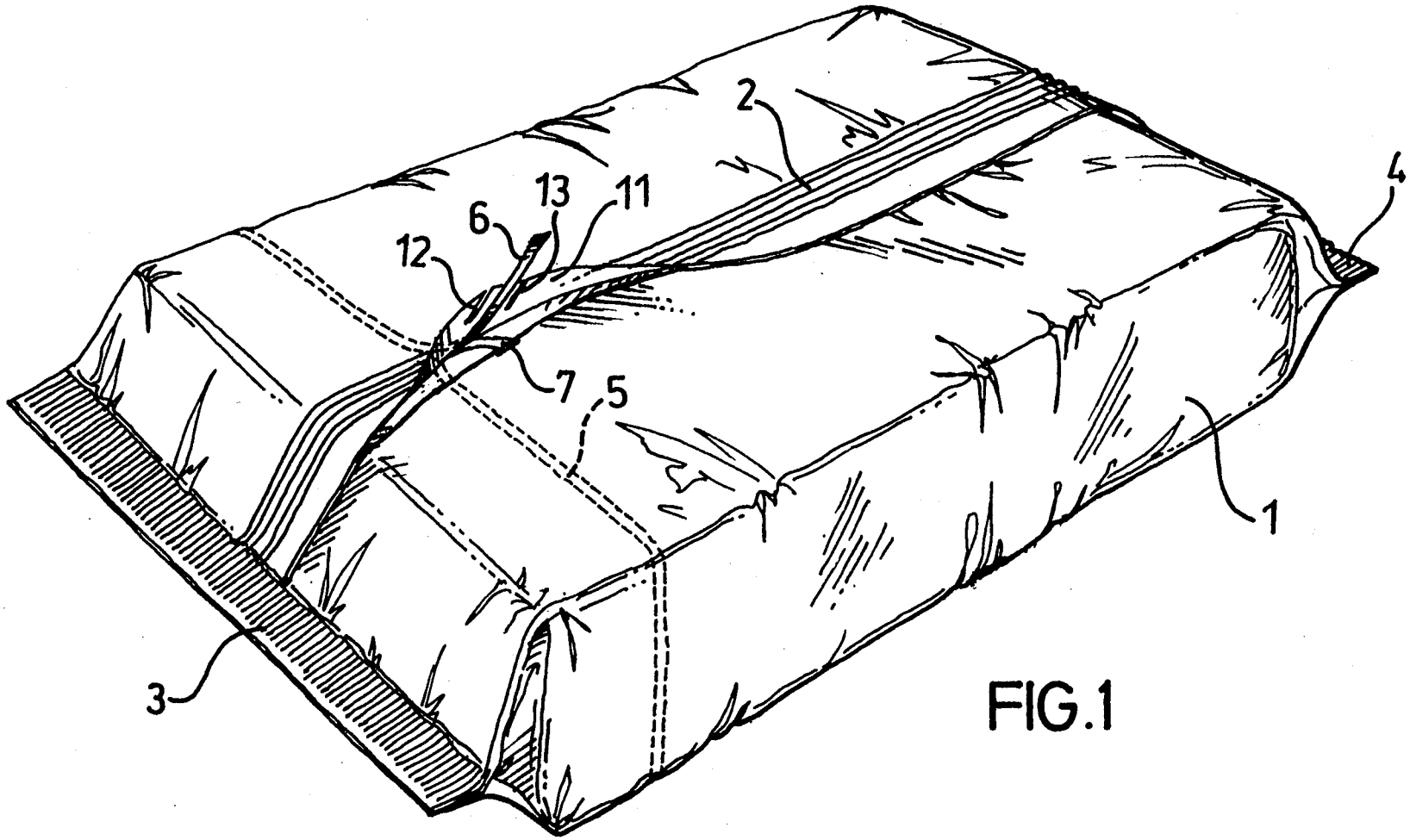
FIG. 1 is a perspective view of a package of "flow pack" type provided with a tear-strip in accordance with the present invention.

FIG. 1 is a perspective view of a package with a sealed wrapper of the flow pack type provided with a wire/strip tear opener in accordance with the present invention.

The wrapper 1 has a longitudinal sealing fin 2 and two transverse seals 3, 4 which approximately define a rectangular volume.

Transversely of the longitudinal fin 2, on the outer face of the wrapper a tear strip 5 is fitted, mechanically or by self adhesion, heating or other suitable means, depending on the material of the wrapper; one end 6 of the strip 5 projects from the welded fin, and the strip extends entirely around the wrapper so as to form a loop with superimposed ends.

Figure 4:
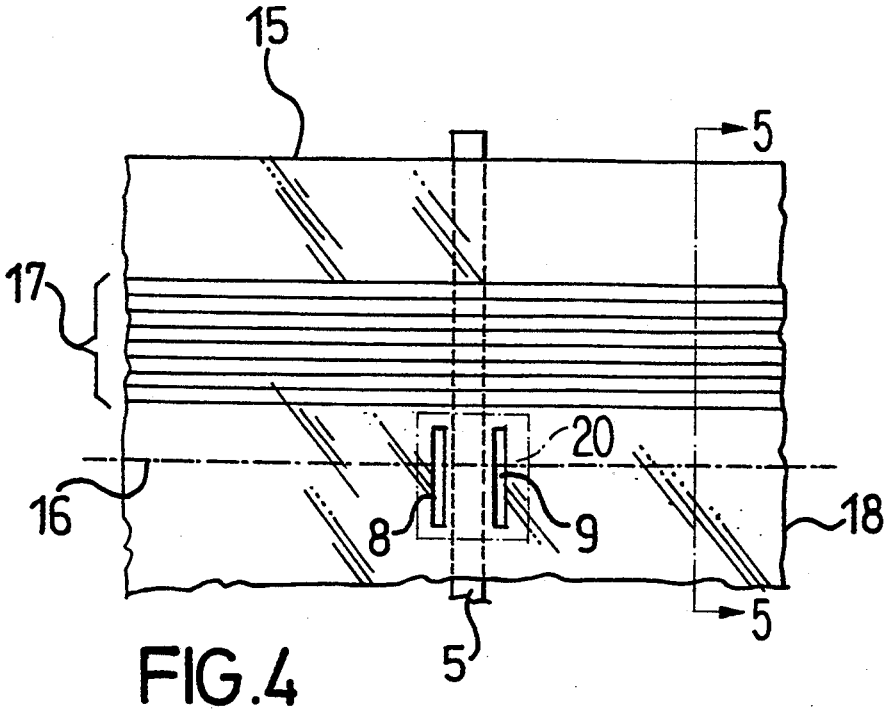
FIG. 4 is a front view of a portion of a longitudinal fin and a wrapper provided with incisions to facilitate tearing open, and an incision reserve zone and tear starter.
Figure 5:
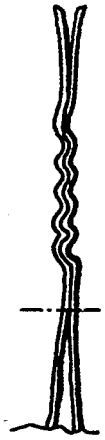
FIG. 5 is a sectional view taken on the line 5—5 of FIG. 4.

The tear strip may be a wide strip as shown in FIGS. 4 and 5 or may be a thread (not shown).

FIG. 1 shows that the longitudinal fin 2 is folded from one side towards the observer by the effect of the double transverse sealing at the ends so that, whilst the path of the strip 5 in the region corresponding to the end 6 is, if not rectilinear, at least subjected to only modest curvature, at the other end 7 the path is sharply folded in a U-shape at the fin.

Figure 2:
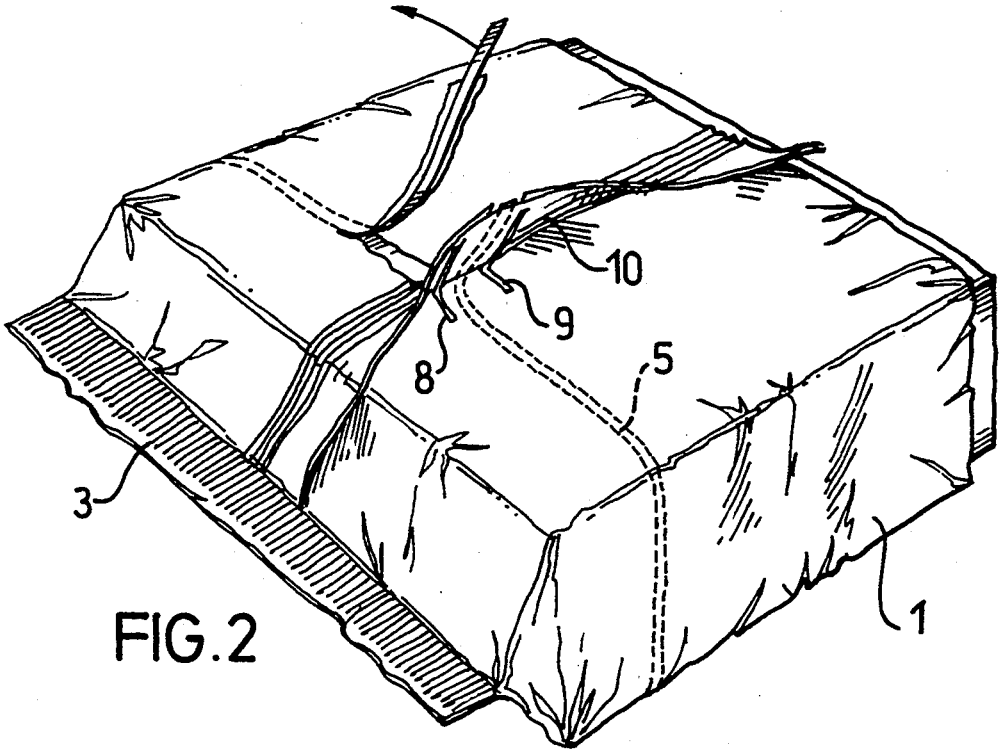
FIG. 2 is a perspective view of the package of FIG. 1 in an initial wrapper-openning stage using the tear strip, and showing the wrapper incisions which allow the complete tearing open of the wrapper and the fin.
Figure 3:
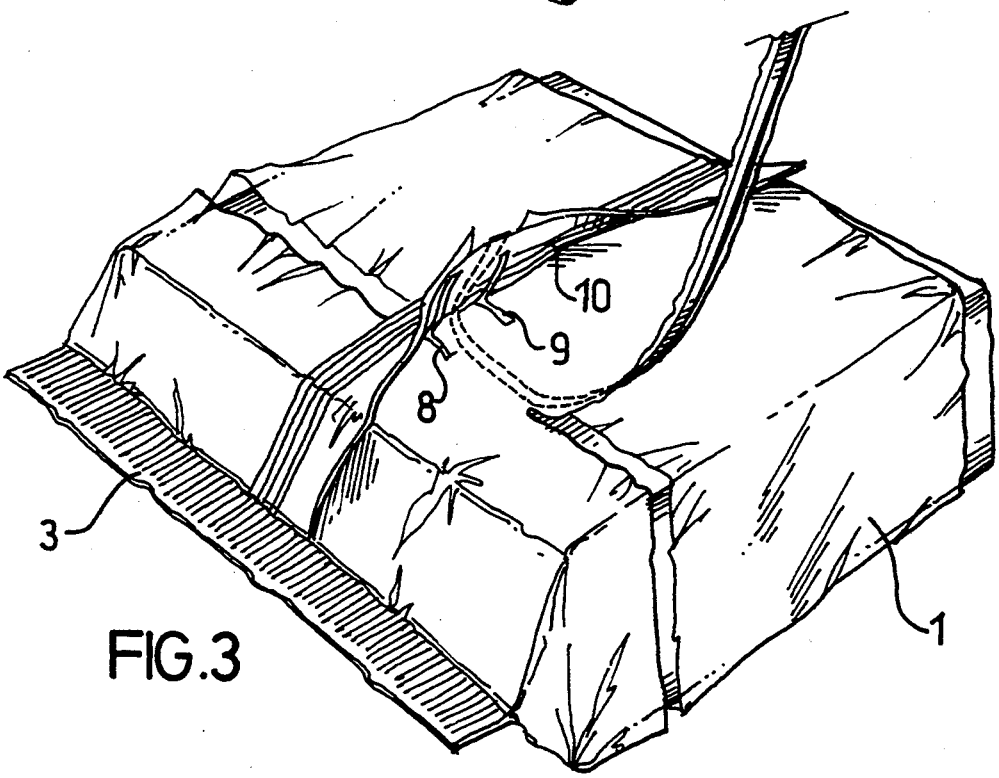
FIG. 3 is a perspective view of the package of FIG. 1 in the final opening stage.

As already mentioned, in the absence of other arrangements, the strip 5 will not be able to function to tear the entire wrapper, to obtain which, according to the invention, and as better seen in FIGS. 2 and 3, during the packaging operation there are formed on the wrapper two small incisions 8 and 9 which lie alongside the tear strip at the fold 10 on the edge of the wrapper inside the fold.

As illustrated in FIG. 1, the opposite edge 11 outside the fold has two incisions 12, 13 which lie alongside the end 6 of the strip to facilitate the initial tear upon opening.

The incisions 8, 9 of FIG. 2 and 12, 13 of FIG. 1 can have an overall length of the order of 2–6 millimeters and can pass right through (in the case of packages which do not require hermetic sealing of the product) or only partly through and, depending on the material of which the wrapper is made, can be formed with simple blades, heated blades or punches having a calibrated depth.

FIG. 2 illustrates the initial phase of tearing open the wrapper and FIG. 3 the final stage of this operation.

When the tear on either side of the strip 5 caused by pulling on the strip reaches the two incisions 8 and 9 the part of the wrapper inside the fold and the incisions, no longer held by the other parts of the fin outside the incisions, therefore yields giving a rounding of the fold which avoids the sharp interruption to the strip's tearing action.

The tearing action can thus proceed without disadvantages beyond the fold formed by the fin to cause total separation of the wrapper and the longitudinal fin.

It has already been indicated that the incisions 8 and 9 can be either right through or partly through the wrapper.

It is evident, however, that incisions passing right through can be hermetically sealed, after cutting, with suitable local treatment with the single effect of sealing. The local treatment for sealing the incisions can be a film of gelatin 20 disposed in overlying relation to the incisions as shown schematically in FIG. 4.

Protection of the region weakened by the incisions and the sealing thereof against external stresses, pressures and knocks is ensured by folding the fin to one side during the packaging operation.

According to a further aspect of the invention, to prevent the sealing operation and the formation of the fin from being able in any way to modify the characteristics of the incisions, a reserve band can be left between the fin fold lines and the sealing region, in which band the incisions are located so that they are therefore not influenced by subsequent sealing treatment of the fin.

Preferably, the reserve band can be restricted to a limited region.

These aspects are illustrated schematically in Figures from 4 to 7.

FIGS. 4 and 5 show, in front view and cross section respectively, a portion 15 of the longitudinal fin and the flow pack package, orientated perpendicularly of the surface of the wrapper.

It is clear that during the packaging operation the illustrated portion of the fin is folded perpendicularly of the plane of the drawing along a fold line 16 indicated in broken outline.

At this line the portions of the wrapper, represented in plan, which overlie one another, are in fact, when the packaging is finished, separated and disposed perpendicularly with respect to the plane of the drawing.

The fin sealing and treatment is constituted by a sealing band 17 which leaves between the fold line and this band, a reserve zone 18 in which lie the incisions 8, 9, which lying alongside the underlying tear strip 5, are interposed between the two walls of the fin and are therefore indicated in broken outline.

The incisions 8, 9, even if made before the sealing operation, are therefore not influenced by this treatment.

Figure 6:
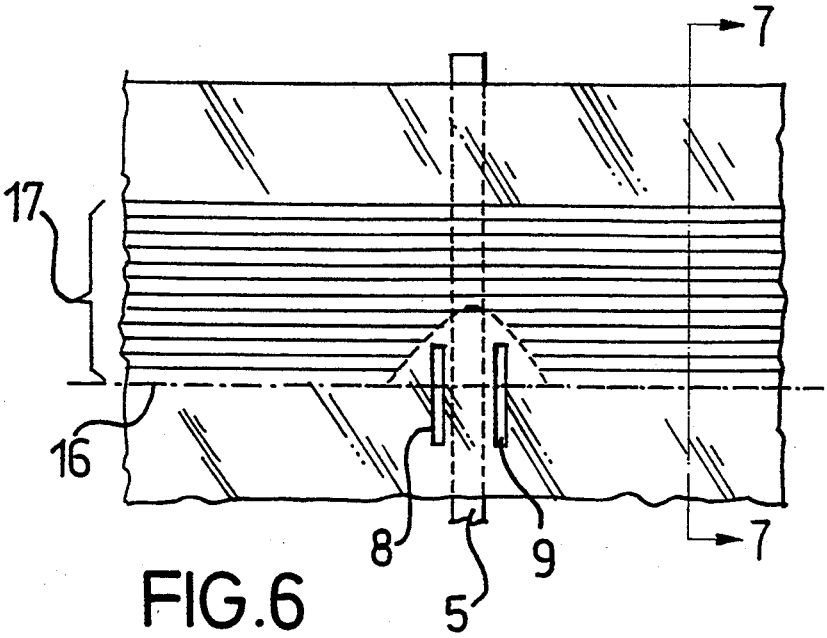
FIG. 6 is a front view similar to FIG. 4 showing a modified incision reserve zone.
Figure 7:
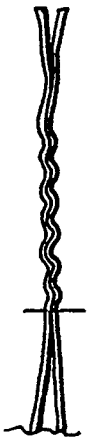
FIG. 7 is a sectional view taken on the line 7—7 in FIG. 6.

Alternatively, as illustrated in FIGS. 6 and 7 which show in front view and section a portion 15 of the longitudinal flap, as in the case previously examined, the sealing band 17 of the flap extends up to the fold line 16 of the wrapper but locally, in correspondence with the tear strip 5 and the incisions 8 and 9, has a reduced width, which leaves a reserve zone 18 of approximately triangular shape indicated in broken outline, in which the incisions 8 and 9 are disposed.

In this zone the two walls of the fin are not joined together and therefore the reserve zone 18, as well as ensuring that the incisions 8 and 9 are not influenced by the flap sealing operations, provides a more yielding starter which facilitates the tearing operation.

With these arrangements it is possible easily to obtain incisions which combine the required impermeability (by control of the depth of incision or subsequent sealing) with the local structural weakening of the wrapper to allow it and the flap to be torn by means of the tear strip.

What is claimed is:

1. A package with a sealed wrapper having a longitudinal closure fin having a free edge folded flat on to said wrapper along a fold line including a tear strip means disposed in a loop under said wrapper and extending transversely of said fin, said wrapper and said fin having, along said fold line, two incisions having end spaced from the free edge of said fin and extending transversely of said fold line and alongside, respectively on one side and the other, of said tear strip means.

2. A package as in claim 1, in which said incisions pass right through the wrapper.

3. A package as in claim 1, in which said incisions extend only partly through the wrapper.

4. A package as in claim 1, in which said fin has a sealing band spaced from said fold line, at least in the region of said tear strip means and said incisions, by an unsealed reserve zone.

5. A package as in claim 1, including a film of sealing material superimposed on to said wrapper and said fin in correspondence with said incisions.

* * * * *